US006892916B1

(12) United States Patent
Rugg

(10) Patent No.: US 6,892,916 B1
(45) Date of Patent: May 17, 2005

(54) BAG FOR CARRYING A BALL

(75) Inventor: Douglas Rugg, Costa Mesa, CA (US)

(73) Assignee: DR Imports Ltd, Costa Mesa, CA (US)

( * ) Notice: Subject to any disclaimer, the term of this patent is extended or adjusted under 35 U.S.C. 154(b) by 0 days.

(21) Appl. No.: 09/527,066

(22) Filed: Mar. 17, 2000

Related U.S. Application Data

(63) Continuation-in-part of application No. 09/365,468, filed on Aug. 2, 1999, now abandoned.

(51) Int. Cl.[7] ..... A47F 3/02

(52) U.S. Cl. ..... 224/645; 224/257; 224/605

(58) Field of Search ..... 224/257, 258, 224/600, 601, 603, 604, 605, 645; 383/15, 40, 25; 150/107, 108; 206/315.9, 315.91; D3/257, 258, 271; 190/903, 115

(56) References Cited

U.S. PATENT DOCUMENTS

| | | | | | |
|---|---|---|---|---|---|
| 1,717,587 | A | * | 6/1929 | Shipley | 206/315.9 |
| 1,914,087 | A | * | 6/1933 | Gilmore | 383/40 |
| 2,561,888 | A | * | 7/1951 | Ruge | 190/41 |
| D248,189 | S | * | 6/1978 | Loomis | D87/3 C |
| 4,510,982 | A | * | 4/1985 | Sangroni | 206/315.9 |
| 5,060,767 | A | * | 10/1991 | Pulichino, Jr. et al. | 190/111 |
| 5,085,320 | A | * | 2/1992 | Scott | 206/315.9 |
| D335,956 | S | * | 6/1993 | Lucas | D3/44 |
| D339,915 | S | * | 10/1993 | Lucas | D3/44 |
| D346,273 | S | * | 4/1994 | Lucas | D3/271 |
| D375,626 | S | * | 11/1996 | Eaton et al. | D3/257 |
| D384,199 | S | * | 9/1997 | Dixon et al. | D3/217 |
| 5,735,608 | A | * | 4/1998 | Branco | 383/25 |
| D394,348 | S | * | 5/1998 | Aliff | D3/238 |
| 5,839,577 | A | * | 11/1998 | Friedler | 206/315.1 |
| 5,890,809 | A | * | 4/1999 | Nelson | 383/40 |
| 5,927,581 | A | * | 7/1999 | Reddy et al. | 224/578 |
| D417,074 | S | * | 11/1999 | Rugg | D3/257 |
| 6,095,390 | A | * | 8/2000 | Bogle | 224/664 |

* cited by examiner

*Primary Examiner*—Joseph C. Merek
(74) *Attorney, Agent, or Firm*—Daniel J. Meaney, Jr.

(57) ABSTRACT

A bag for carrying a ball is shown. The bag comprises an outer member having an exterior surface configured in the shape of a ball and includes an opening positioned therein in a selected direction for inserting and removing a ball therefrom. A fastening member, having an open and a closed position, is operatively connected to the opening. The fastening member is adapted to make the opening an unsecured opening when the fastening member is in the open position and a secured opening when the fastening member is in a closed position. A carrying handle, having a first end and a second end, is operatively connected to the outer member and is positioned relative to the opening. The carrying handle may be substantially perpendicular to the opening or in alignment with the opening. At least one outer pocket having an entryway is positioned on the exterior surface of the outer member at a location other than the opening enabling the insertion and removal of an article or articles from the interior cavity of the outer pocket. In the preformed embodiment, the outer pocket is formed of an open mesh or fabric material. A ruggedized carrier may be used to transport and carry the bag and ball stored therein.

17 Claims, 6 Drawing Sheets

100
64
60
68
70
76
79
78
80
72
90
92
52
30
34
42
40
42
40
44
44
50
38

38
34
30
60
40
76
79
78
40
44
100
64
44
52
50
90
80

100
64
60
66
30
52
40
38

50
44
34
38
34
30
40
64
44
52
50

110
60
64
100
104
106

BAG FOR CARRYING A BALL

RELATED APPLICATION

This Application is a Continuation-in-Part of U.S. patent application Ser. No. 09/365,468 filed Aug. 2, 1999 now abandoned.

BACKGROUND OF THE INVENTION

1. Field of the Invention

This invention relates to device for carrying a ball and more particularly relates to a device for carrying of balls having a variety shapes and outer circumferences, such as, for example, shapes of basketballs, soccer balls, volley balls, footballs and the like. In the preferred embodiment, the device includes at least one outer pocket positioned on an exterior surface of an outer member enabling the insertion and removal of an article or articles from the interior cavity of the at least one outer pocket.

2. Description of the Prior Art

Devices for carry balls and ball bags are well known in the art. Typical of such devices are the devices disclosed in U.S. Design Pat. Nos. Des. 375,626; Des. 363,817; Des. 349,008; Des. 346,273; Des. 339,915 and Des. 332,350. U.S. Pat. No. Des. 384,199 discloses a back pack in the form of a ball. U.S. Pat. Nos. 1,717,587; 1,927,492 and 5,238,162 disclose various devices for carrying of balls.

U.S. Design Pat. No. Des. 393,364 discloses an ornamental design for a tennis ball caddy having an open mesh fabric panel, or in the alternative, a transparent window in lieu of the open-mesh panel.

U.S. Pat. No. 5,839,577 discloses a bag for holding athletic articles in he form of balls wherein the bag comprises an outer shell having an interior surface. The outer surface is configured in the shape of an athletic ball and includes a securable opening for inserting an removing article therefrom. The interior surface of the outer shell is provided with a first strip of fastening means for mating engagement with a second strip of fastening means positioned on the exterior surface of an inner lining which is removably securable within the outer shell such that the lining conforms to the shape of the outer shell when it is positioned therein. A handle is provided on the outer shell for carrying and transporting the bag.

None of the prior art devices disclose, suggest or teach a device for carry a ball wherein the outer member is used for supporting a carrying handle, which may be in the form of a ruggedized carrier, together with at least one separate exterior outer pocket to enable the user to carry a ball in the inner enclosed space of the carrying device while concurrently have an exterior outer pocket to carry an article or articles. The at least one outer pocket includes an entryway which may be open or which may be secured with a cooperating fastener member and mating member. The at least one outer pocket may be used for carrying an article or articles such as for example personal effects including keys, billfolds, wallets, sunglasses, money, money purse, cell phone and the like (hereinafter referred to collectively as "Personal Effects").

The concept of a bag for carrying a ball having at least one integrated, exterior, accessible outer pocket having an entryway, which in the preferred embodiment may be a mesh pocket, is not disclosed, suggested or taught by the prior art. The outer pocket may include a cooperating fastener member and a mating member to secure the entryway. The outer pocket may be used for storing Personal Effects whether or not the inner enclosed space of a bag has an athletic article in the form of a ball inserted therein.

The separate outer pocket eliminates the necessity for the user to carry a separate bag, purse or the like for carrying an article or Personal Effects and eliminates commingling the Personal Effects inside of the bag with the athletic article in the form of a ball carried thereby.

None of the prior art United States Patents or United States Design Patents listed above disclose, suggest or teach the combination of a ball carrying device having at least one exterior, accessible outer pocket including a mesh pocket.

The tennis ball caddy disclosed in U.S. Design Pat. No. Des. 393,364 discloses an open-mesh fabric to hold the tennis balls and is essentially in the form of a device for carrying only a tennis ball. Of most importance, is that U.S. Design Pat. No. Des. 393,364 does not disclose, suggest or teach the use of fabric or mesh outer pocket as a separate outer pocket for carrying Personal Effects.

U.S. Pat. No. 5,839,577 does not discloses, teach or suggest an accessible, fabric outer pocket as a separate pocket for carrying Person Effects.

SUMMARY OF THE INVENTION

A novel, new and unique bag for holding a ball is disclosed and taught herein. The bag comprises an outer member having an exterior surface configured in the shape of a ball and which defines an inner enclosed space. The exterior surface of the outer member includes an opening formed therein in a selected direction and the opening is in communication with the inner enclosed space for affording and enabling the insertion and removal of ball therefrom. A fastening member, having an open and a closed position, is operatively connected to or operatively attached to the periphery of the opening and is adapted to make the opening an unsecured opening when the fastening member is in the open position and to make the opening a secured opening when the fastening member is in a closed position. A carrying handle, having a first end and a second end, is operatively connected to the outer member and is positioned in a selected direction relative to the opening. At least one outer pocket is positioned on the exterior surface of the outer member at a location other than the opening and spaced from the carrying handle. The opening has an entryway to enable the insertion and removal of articles from the at least one outer pocket independent of whether a ball is or is not inserted into and/or located in the inner enclosed space.

A ruggedized carrier for carrying and transporting a ball bag having an outer member defining an opening for affording the insertion and removal of a ball therefrom including having a ball stored therein is also disclosed. The ruggedized carrier comprises a carrying handle having a first end and a second end. The carrying handle is operatively connected to the outer member and is positioned in a selected direction relative to the opening. An elongated strap, having a first end and a second end terminating in a connecting member, is operatively connected to the outer member. A loop member, having a mounting end and a central opening, has the mounting end operatively mounted on the outer member. The loop member is operatively coupled to the connecting member forming a closed carrying handle wherein the connecting member is moveable within the central opening.

The prior art does not disclose, suggest or teach a bag for carrying a ball having an outer member and defining an exterior surface wherein the outer member is configured in the shape of a ball, has an opening positioned therein for inserting and removing a ball therefrom and wherein the bag comprises at least one outer pocket having an entryway. The at least one outer pocket is being positioned on the exterior surface of the outer member at a location other than the opening enabling the insertion and removal of articles from at least one outer pocket.

One advantage of the present invention is that the device for carrying a ball can be formed of any shape resembling any one of a number of known athletic or other ball shapes, such as, for example without limitation, a baseball, a basketball, a football, a soccer ball, a tennis ball, a kerf ball, a beach ball, a bowling ball, a golf ball, a volley ball, and other similar or known balls used for sports, recreation, therapy, outdoor recreation, indoor recreation or the like. It is obvious to a person skilled in the art that other athletic articles generally in the shape of or form of a ball could likewise be inserted into the inner enclosed space of a ball bag and be carried thereby. All such athletic, recreation and equivalent balls are envisioned to be able to be carried by a bag disclosed herein. As such, all such articles generally in the form of balls or adapted to be essentially in the shape of the bag or adapted to be carried within a ball shaped bag are deemed to be within the spirit of and scope of the present invention. A detailed listing thereof is not believed necessary for an understanding of the teachings and applications of the present invention.

Another advantage of the present invention is that bag for carrying a ball may be configured in the shape of one of a variety of balls to be carried thereby.

Another advantage of the present invention is that the opening formed in the outer member of a bag communicates with an inner enclosed space to enable the insertion and removal of a ball therefrom.

Another advantage of the present invention is the opening formed in the outer member of the bag may include a fastening member, having an open and a closed position, which is operatively connected to the opening and adapted to make the opening an unsecured opening when the fastening member is in the open position and which is adapted to make the opening a secured opening when the fastening member is in a closed position. The fastening device may be any known fastening device such as for example, a zipper, buttons with cooperating button holes, snaps, mating members forming a VELCRO fastener, which is known in the art as a hook and loop fastener, namely, fasteners comprises of material having a surface of hooks mated with material having a surface of loops, and the like.

Another advantage of the present invention is that a carrying handle may be operatively connected to the outer member and be positioned in a selected direction relative to the opening, such as being perpendicular to or in alignment with the opening.

Another advantage of the present invention is that the bag may include at least one outer pocket positioned on the exterior surface of the outer member at a location other than the opening and be spaced from the carrying handle. The at least one outer pocket includes an entryway enabling the insertion and removal of an article or Personal Effects from the at least one outer pocket independent of a ball being inserted into and/or located in the inner enclosed space.

Another advantage of the present invention is that the at least one outer pocket may be formed of a variety of materials such as for example, a sold fabric. An open mesh fabric, a mesh fabric, an elastic fabric, an elastic mesh fabric, or a fabric which has the appearance of a blue jean material or a camouflage material.

Another advantage of the present invention is that the bag may include a second outer pocket positioned on the exterior surface of the outer member at a location other than the opening and spaced from the at least one outer pocket.

Another advantage of the present invention is that the bag may include a carrying handle having an elongated strap and a loop member forming a closed carrying handle wherein a connecting member is moveable within a central opening. A hook, ring member or key ring may be operatively connected to the carrying handle.

Another advantage of the present invention is that a ruggedized carrier for a ball bag may be operatively connected to the outer member of the ball bag cooperating with a carrying handle. A hook, a ring member or key ring may be operatively connected to the ruggedized carrier for removeably attaching the same to the carrier.

BRIEF DESCRIPTION OF THE DRAWINGS

The foregoing and other advantages of this invention will be apparent from the following description of the preferred embodiment of the invention when considered with the illustrations and accompanying drawings that include the following Figures.

DESCRIPTION OF THE PREFERRED EMBODIMENT

Figures 1, 2, 3, 4, 5:
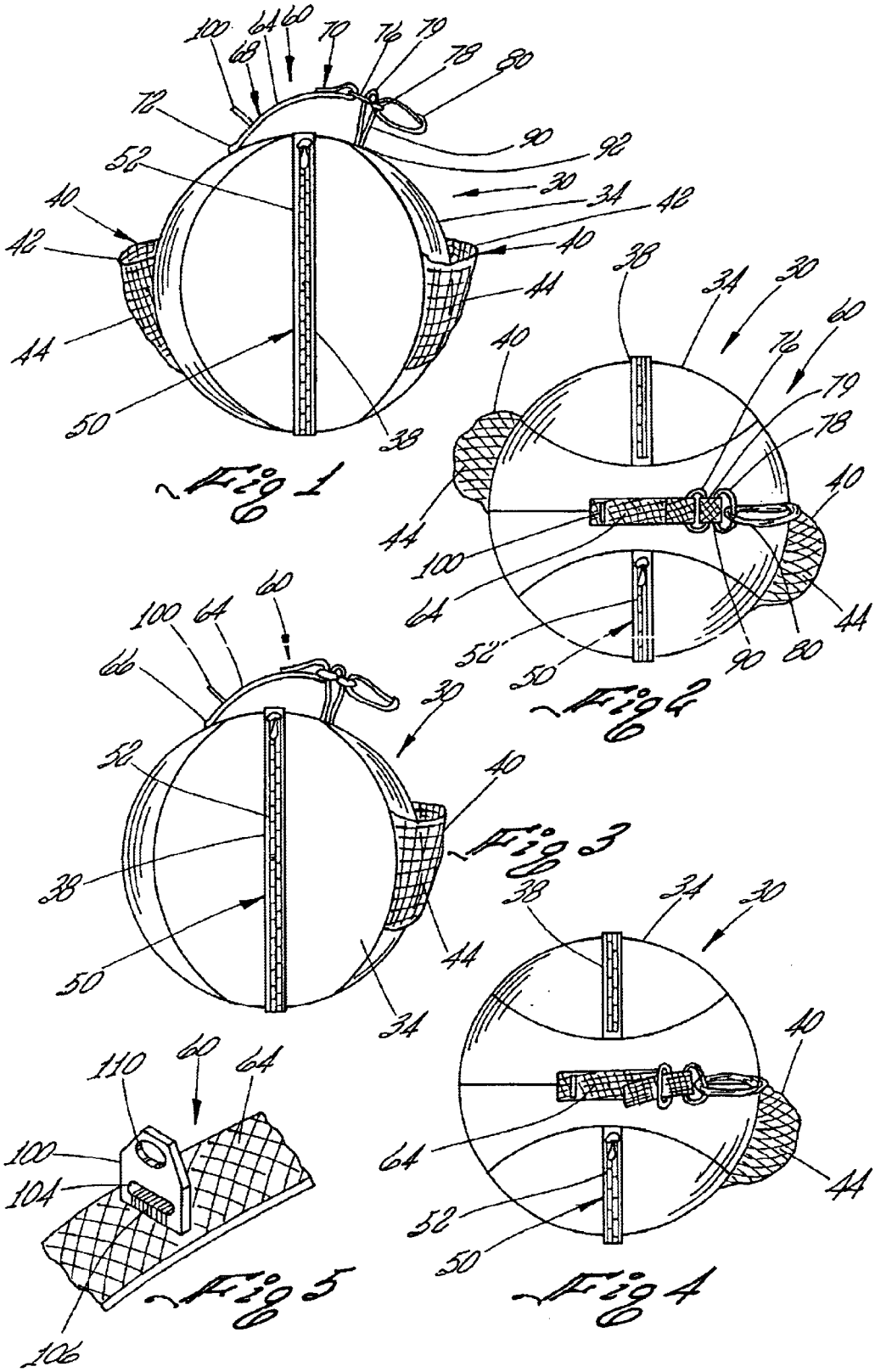
FIG. 1 is a front elevational view of the ball bag in the form of a circular ball having an outer member including an opening formed therein in a selected direction and a carrying handle oriented substantially perpendicular to the opening and wherein the bag has located on the outer member thereof at least two outer pockets each having an entryway.
FIG. 2 is a top plan view of FIG. 1.
FIG. 3 is a front elevational view of another embodiment of a ball bag in the form of a circular ball having an outer member including an opening formed therein in a selected direction and a carrying handle oriented substantially perpendicular to the opening and having located on the outer member at least one outer pocket having an entryway.
FIG. 4 is a top plan view of the embodiment of FIG. 3.
FIG. 5 is a pictorial representation of a carrying handle having a "D" ring operatively attached thereto and adapted to have a key ring removeably connected thereto.

FIGS. 1 through 4 disclose, generally, athletic bags generally in the form of a circular ball which is shown by arrow 30 designed to carry a ball. In the embodiment of FIGS. 1 and 2 wherein the shape of the ball is spherical, the bag 30 has an outer member 34 defining an exterior surface that is configured in the shape of a ball. The outer member 34 defines an opening shown generally as 38 positioned or formed on the exterior surface of outer member 34. The opening 38 is used for inserting and removing a ball from the bag 30.

In the embodiment of FIGS. 1 and 2, the exterior surface of outer member 34 supports at least one outer pocket shown by arrow 40 having an entryway 42. As illustrated in FIG. 2, the two outer pockets 40 are positioned in an opposed space relationship. As such, the two outer pockets 40 are located on opposite sides of the exterior surface of outer member 34 and away from the opening 38.

The at least one outer pocket 40 is shown as an open mesh fabric 44, which in the preferred embodiment, is an elastic mesh fabric. In the alternative and as illustrated FIGS. 26 and 27 and as discussed below in connection with FIGS. 26 and 27, the outer pocket may be formed of a solid fabric or of a transparent material.

In the embodiments of FIGS. 1 and 2, the opening 38 includes a fastening member, shown generally as arrow 50, which in this embodiment is a zipper 52. The fastening member 50, or zipper 52, has an open position and a closed position. The fastening 50, generally, and the zipper 12, specifically in this embodiment, operatively connected to the opening 38 and is adapted to make the opening 38 an unsecured opening when the zipper 52 is in an open position. The zipper 52 when in the closed position defines a secured opening, that is an athletic or other ball insert therein is retained within the interior of the outer member 34 and cannot fall out of or be removed from the outer member 34 of bag 30 when the zipper is closed.

As illustrated in FIG. 1, a carrying handle, shown generally as 60, has a first strap member 64 having a first end 68 and a second end 70 The first end 68 is operatively secured to the outer member 34 at location 72. The second end 70 is formed into a loop and terminates in a connecting member 76.

The carrying handle 60 includes a second strap member 90 which has a first end 92 and a second end 79. The first end 92 is operatively mounted on the exterior surface of the outer member 34. The second end 79 interacts with the connecting member 76 to form a carrying handle 60 for carrying and transporting the bag. The connecting member 76 and the second end 79 are moveable relative to each other.

A fastening member 50 is located within the opening 38 and extends in a selected direction on the outer member 34. At least a portion of the fastening member 50 extends in a direction substantially perpendicular to the carrying handle 60. The carrying handle 60 is positioned to refrain from interfering with the inserting and removing of a ball from the outer member 34 defining the bag.

Figure 14:
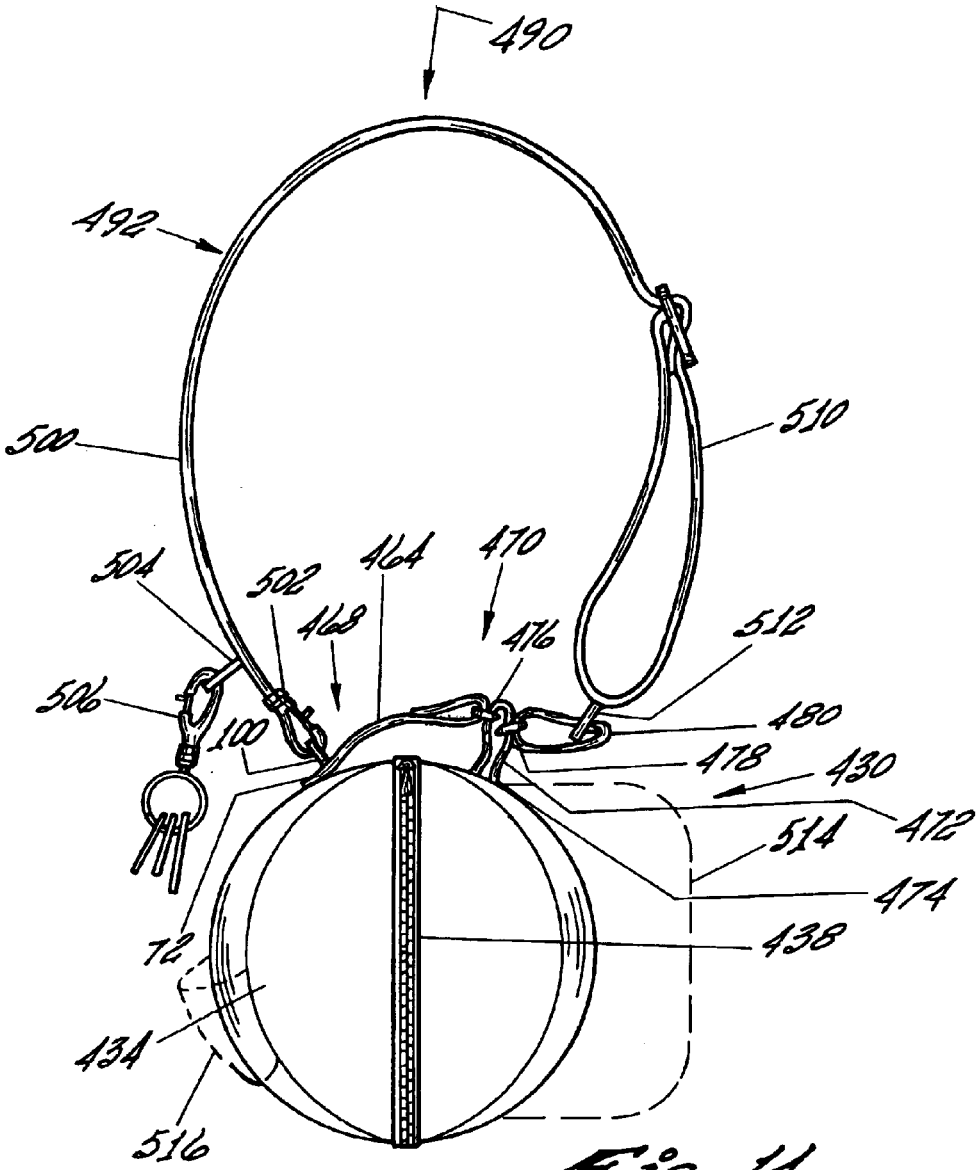
FIG. 14 is a front elevational view of still yet another embodiment of a circular shaped ball bag comprising an outer member having an opening extending in a selected direction on the outer member, a fastening member operatively connected to the opening, a ruggedized carrier, at least one outer pocket shown as a dashed line and a pair of shoulder straps operatively connected to said exterior surface of the outer member enabling a user to carry the bag in a manner similar to backpack.

In the embodiment illustrated in FIG. 1 and as illustrated in further detail in FIG. 5, a "D" shaped ring member 100 is operatively secured to the outer surface of the first strap 64. The "D" shaped ring member 100 has an elongated slot 104, shown in FIG. 5, which is used for sewing the "D" shaped ring member 100 to the first strap 64 which is illustrated by threads 106. The "D" shaped ring member 100 also has an aperture 10 which is adapted to hold a key ring or the like, an example of which is illustrated in FIG. 14.

Figure 6:
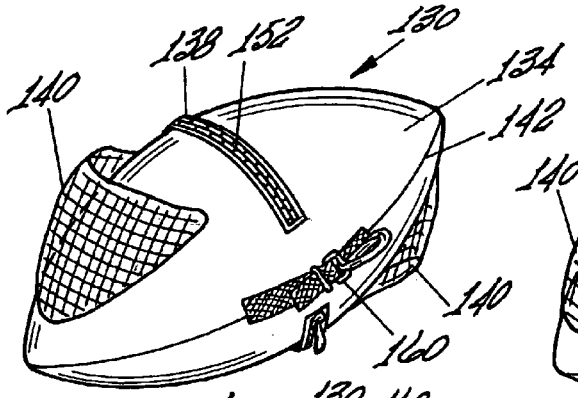
FIG. 6 is a front, left side and top perspective view of yet another embodiment of a bag in the form of a football having an outer member including an opening formed therein in a selected direction and a carrying handle oriented substantially perpendicular to the opening and wherein the bag has located on the outer member at least two outer pockets each having an entryway.
Figure 7:
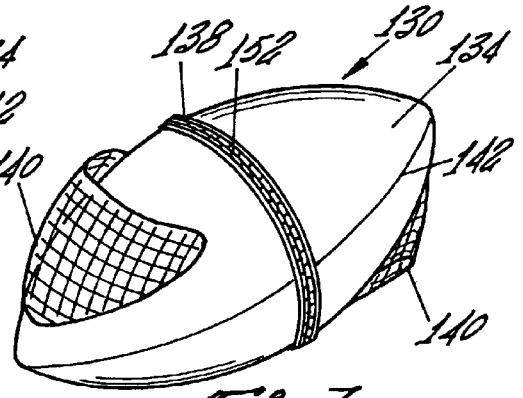
FIG. 7 is a rear, right side and bottom perspective view of the embodiment of FIG. 6.
Figure 8:
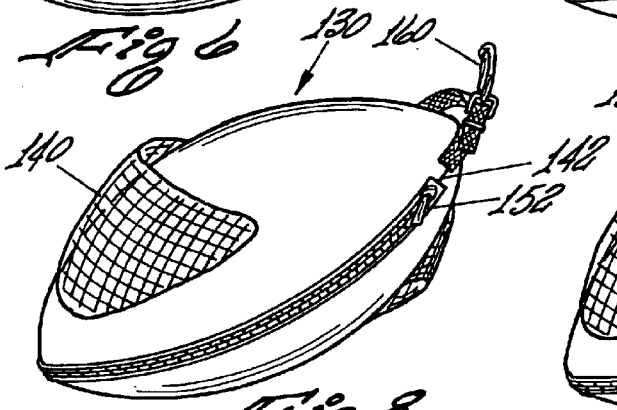
FIG. 8 is a front, left side and top perspective view of still yet another embodiment of a bag in the form of a football having an outer member including an opening formed therein in a selected direction and a carrying handle oriented substantially in alignment to the opening and wherein the bag has located on the outer member at least two outer pockets each having an entryway.

FIGS. 6 through 8 illustrate an embodiment wherein the bag, shown generally as 130 is in the shape of a football. In FIGS. 6. and 7, an opening 138 is located to extend substantially perpendicular to the seam 142 of the football shaped bag. In the embodiment of FIGS. 6 and 7, the opening 138 is in the form of a zipper 132. A carrying handle shown generally as 160 is operatively connected to the outer surface 134 at a location which is substantially parallel to the seam 142.

In the embodiment of FIGS. 6 and 7, two mesh pockets shown as 140, are operatively attached to exterior surface of outer member 134 and in spaced opposed locations, both of which are positioned away from the opening 138.

Figure 9:
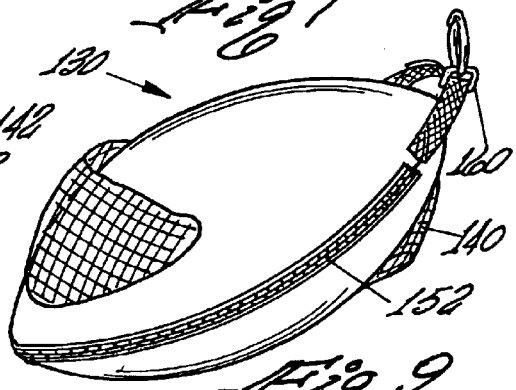
FIG. 9 is a rear, right side and bottom perspective view of the embodiment of FIG. 8.

In the embodiments of FIGS. 8 and 9, the opening 138 and zipper 152 are located substantially parallel to the seam 142 and the carrying handle 160 is located at one of the ends of the football shape outer surface 134 and in substantial alignment with opening 138. In the embodiment of FIGS. 8 and 9, two mesh pockets, shown as 140, are operatively attached to exterior surface of outer member 134 and in spaced opposed locations, both of which are positioned away from the opening 138 and disposed from the carrying handle 160.

Figure 10:
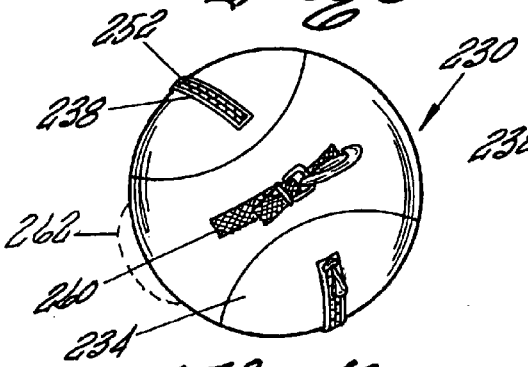
FIG. 10 is a top plan view of a ball bag in the form of a baseball having an outer member including an opening formed therein in a selected direction and a carrying handle oriented substantially perpendicular to the opening and wherein the bag has located on the outer member at one outer pocket at any desired location on the outer member as illustrated by the dashed outer pocket.
Figure 11:
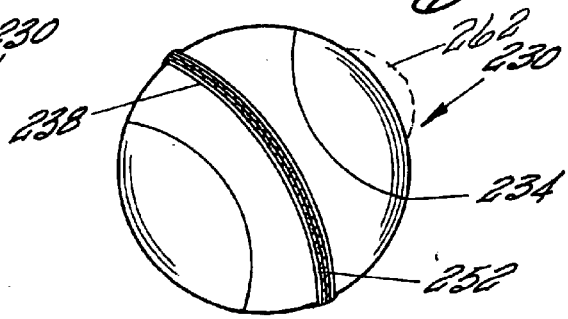
FIG. 11 is a bottom plan of the ball bag in the form of a baseball of FIG. 10.

In the embodiments of FIGS. 10 and 11, the bag 230 is in the shape of a baseball or a similar ball has an opening 238 and zipper 252 which are located circumferentially around the outer member 234. A carrying handle 260, illustrated in FIG. 10, is located substantially perpendicular to the circumferentially extending opening 238 and zipper 252. Mesh pockets, as illustrated as dashed line mesh pockets 262, can alternatively be added to the embodiments illustrated in FIGS. 10 and 11.

Figure 12:
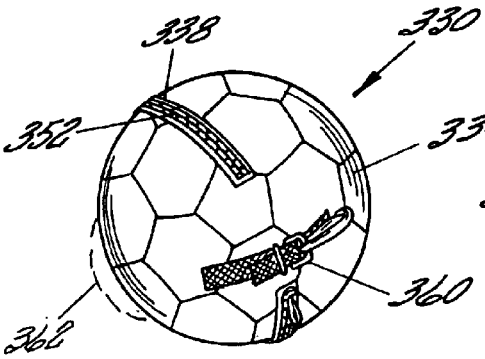
FIG. 12 is a top plan view of a ball bag in the form of a soccer ball having an outer member including an opening formed therein in a selected direction and a carrying handle oriented substantially perpendicular to the opening and wherein the bag has located on the outer member at one outer pocket at any desired location on the outer member as illustrated by the dashed outer pocket.
Figure 13:
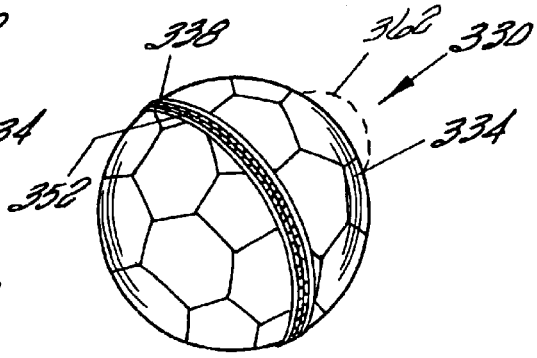
FIG. 13 is a bottom plan of the ball bag in the form of a soccer ball of FIG. 12.

In the embodiments of FIGS. 12 and 13, the bag 330 is in the shape of a soccer ball or a similar ball has an opening 338 and zipper 352 which are located circumferentially around the outer member 334. A carrying handle 360, illustrated in FIG. 12 is located substantially perpendicular to the circumferentially extending opening 338 and zipper 352. Mesh pockets, as illustrated as dashed mesh pockets 362, can alternatively be added to the embodiments illustrated in FIGS. 12 and 13.

FIG. 14 illustrates a combination of a bag for holding a ball with other structural components. In FIG. 14, the bag 430 has an outer member 434 having an exterior surface configured, in this embodiment, in a shape of a spherical ball. The outer member 434 includes an opening shown generally as 438 positioned therein in a selected direction to enable the insertion and removable of articles therefrom including an athletic ball of an appropriate shape and size to be carried within a bag 430.

The bag for holding a ball 430 as illustrated in FIG. 14 includes a ruggedized carrier shown generally as 490 having a carrying handle 464 and an elongated carrying strap 492. The carrying handle 464 has a first end shown by arrow 468 and a second end shown by arrow 470. The first end 468 is operatively connected to the outer member 434 at location 72. The second end 470 terminates in a connecting member 476.

A loop member 472 has a mounting end and a central opening wherein the mounting end is operatively mounted on the exterior surface of the outer member 434 at the location shown as 474. The loop member 472 is operatively coupled to the connecting member 476 forming a closed carrying handle 464 wherein the connecting member 476 is moveable within the central opening of loop member 472.

A slideable connecting member, shown as 480, is joined to the loop member 472 through a second connecting member 478. The slideable connecting member 480 is slideable within the loop member 472.

In the embodiment shown in FIG. 14, a "D" shaped ring 100 is operatively attached to an exterior surface of the carrying handle 464. This "D" shaped ring 100 can be used to directly receive and hold a key ring, such as key ring 506, if desired. Alternatively, the "D" shaped ring 100 can be removeably connected to the elongated strap 500. The elongated strap 500 has a hook member 502 formed on one end thereof and an adjustable loop section 510 supporting a "D" shaped ring 512.

A hook member 502 is adapted to be removeably connected to the "D" shaped ring 100 to secure the same to the bag 430. Another "D" shaped ring 512 may be slideably connected to an adjustable loop section 510 of the elongated carrying strap 500. As such, the "D: shaped ring 512 is also slideably connected to slideable connecting device 480 to secure the same to the bag 430.

The elongated carrying strap 500 may also have an additional or secondary "D" shaped ring 504 operatively attached to the exterior surface of the elongated carrying strap 500. The "D" shaped ring 504 can be used for having a key ring 506 removeably connected thereto for carrying keys or the like.

In this embodiment, both the carrying handle 464 and the elongated carrying strap 500 including the adjustable loop section forming the ruggedized carrier is positioned to be substantially perpendicular relative to the opening 438.

It is within the teachings of the present invention that the bag 430 may include a pair of shoulder straps depicted by dashed lines 514 operatively connected to the exterior surface of the outer member 434 forming a structure enabling a user to carry the bag 430 including a ball as a pack sack or knapsick.

It is envisioned that the bag 430 for holding a ball may comprise the ruggedized carrier 490 alone, or in combination with at least one exterior accessible pocket depicted by dashed lines 516. The at least one outer pocket 516 may be fabricated in the structure of the outer pockets illustrated in FIGS. 15 and 16 as described below.

Figure 15:
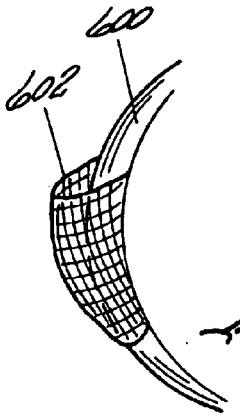
FIG. 15 is a pictorial representation of an outer pocket having an entryway and an interior cavity.

In the pictorial representation of FIG. 15, an at least one outer pocket 602 having an entryway and an interior cavity is operatively attached to an outer member 600 of a bag in the form of a ball. The outer pocket 602 is shown with the entryway formed or fabricated into a permanently open position. The outer pocket 602 is shown in the form of an open mesh material.

Figure 16:
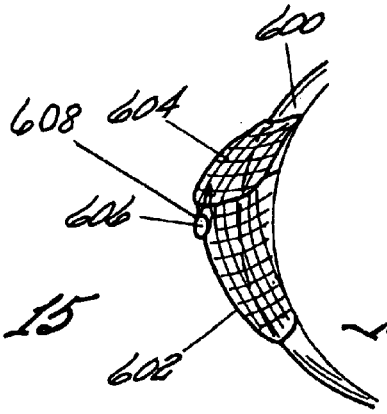
FIG. 16 is a pictorial representation of an outer pocket having an entryway and an interior cavity and wherein the outer pocket includes a fastening member in the form of a button which cooperates with a mating member in the form of flap and loop located on the exterior surface of said outer member.

FIG. 16 is a pictorial representation of the outer pocket 602 having an entryway and an interior cavity and a flap 604 The outer pocket 602 includes a fastening member in the form of a button 606 which cooperates with a mating member 608 in the form of flap 604 and loop 608 located on the exterior surface of the outer member 600.

Figure 17:
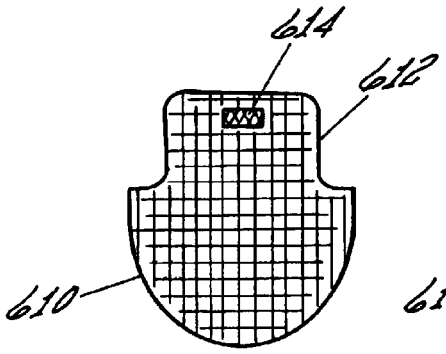
FIG. 17 is a pictorial representation of an outer pocket having a flap integral with the entryway and having a fastening member.

FIG. 17 is a pictorial representation of another embodiment of an outer pocket 610 having a flap 612 integral with the entryway and having a fastening member 614 which is one of two mating elements defining a VELCRO fastener.

Figure 18:
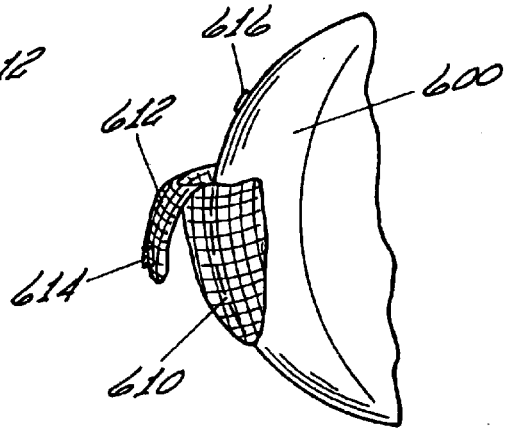
FIG. 18 is a pictorial representation of a bag having the outer pocket illustrated in FIG. 17 operatively connected to the exterior surface of the outer member and a mating member operatively connected to the exterior surface of the outer member.
Figure 19:
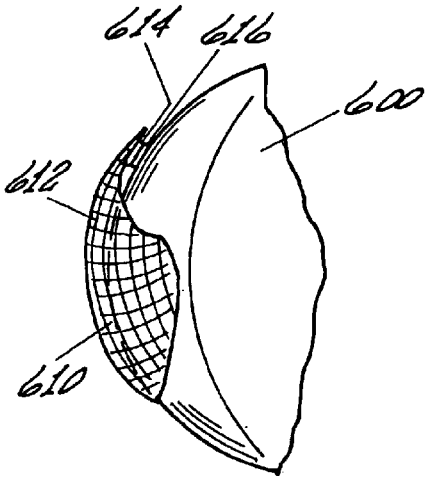
FIG. 19 is a pictorial representation of a bag of FIG. 18 having the fastening member operatively connected to the mating member placing the entryway in a closed position.

FIG. 18 is a pictorial representation of a bag 600 having the outer pocket 610 illustrated in FIG. 17 operatively connected to the exterior surface of the outer member 600. A mating member 616 is operatively connected to the exterior surface of the outer member 600 and forms the other of two mating elements defining a VELCRO fastener. FIG. 19 is a pictorial representation of a bag of FIG. 18 having the fastening member 614 operatively connected to the mating member 616 placing the entryway in a closed position.

Figure 20:
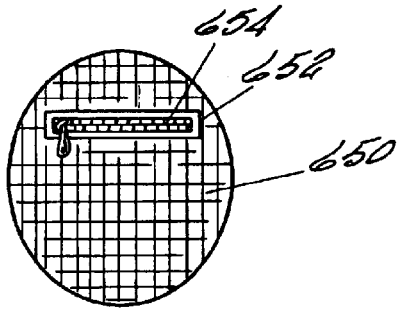
FIG. 20 is a pictorial representation of a another embodiment of an outer pocket having a flap integral with the entryway and having a zipper having elements forming a fastening member and mating member.
Figure 21:
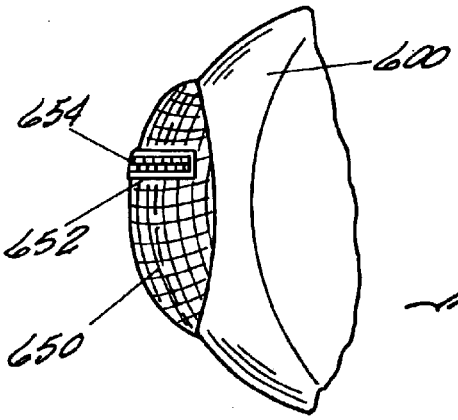
FIG. 21 is a pictorial representation of a bag having the outer pocket illustrated in FIG. 20 operatively connected to the exterior surface of the outer member and the zipper placing the entryway in a closed position.

The pictorial representation of FIG. 20 is another embodiment of an outer pocket 650 having a flap integral with the entryway 652 and having a zipper 654 having elements defining the fastening member and mating member. FIG. 21 is a pictorial representation of the exterior surface of outer member 600 having the outer pocket 650 illustrated in FIG. 20 operatively connected to the exterior surface of the outer member 600 and the 654 placing the entryway in a closed position.

Figure 22:
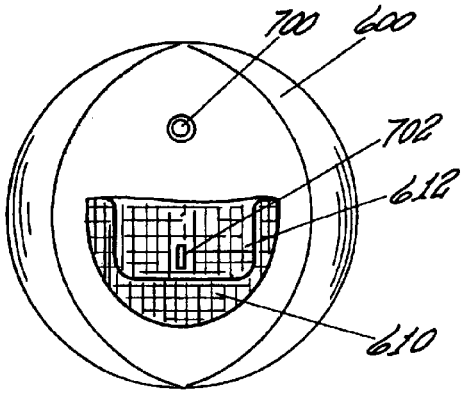
FIG. 22 is a pictorial representation of a bag having the outer pocket similar to that illustrated in FIG. 17 and having located on a flap a fastening member in the form of an aperture and having located located on the exterior surface of the outer member a mating member in the form of a button.

FIG. 22 is a pictorial representation of a bag having an exterior surface of an outer member 600 having an outer pocket that is similar in structure to that illustrated in FIG. 17 and having located on a flap 612 having a fastening member 702 in the form of an aperture. The exterior surface of outer member 600 has located thereon a mating member 700 in the form of a button.

Figure 23:
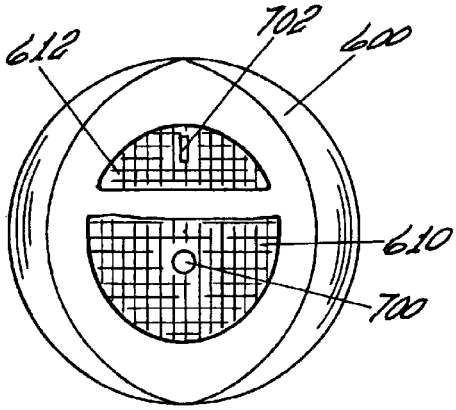
FIG. 23 is a pictorial representation of a bag having the outer pocket having a fastening member in the form of button and a flap operatively attached to the exterior surface of the outer member and wherein the flap has a mating member in the form of an aperture.

In FIG. 23, the pictorial representation of a bag an exterior surface of an outer member 600 having an outer pocket 610 has a fastening member in the form of button 700 and a flap 612 operatively attached to the exterior surface of the outer member 600.

The flap has a mating member in the form of an aperture 702. When the flap 612 is moved downward and the button 700 is passed through the aperture 702, the outer pocket 610 is placed or moved into a closed position to retain or secure in the interior cavity any article or Personal effects placed therein.

Figure 24:
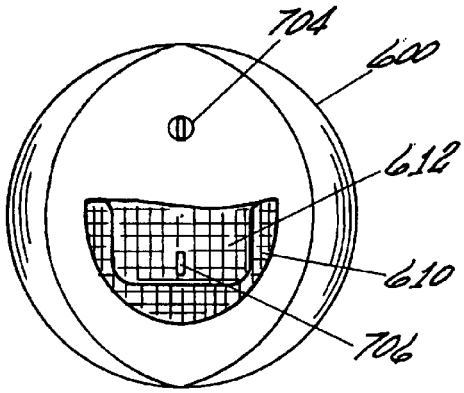
FIG. 24 is a pictorial representation of a bag having the outer pocket similar to that illustrated in FIG. 23 and having located on a flap a fastening member in the form of an aperture and having located located on the exterior surface of the outer member a mating member in the form of a rotatable fastener.

FIG. 24 is a pictorial representation of a bag having an exterior surface of an outer member 600 having an outer pocket 610 similar to that illustrated in FIG. 23 except that the flap 612 has a fastening member in the form of an aperture 706. The exterior surface of the outer member 600 supports or has a mating member in the form of a rotatable fastener 704.

Figure 25:
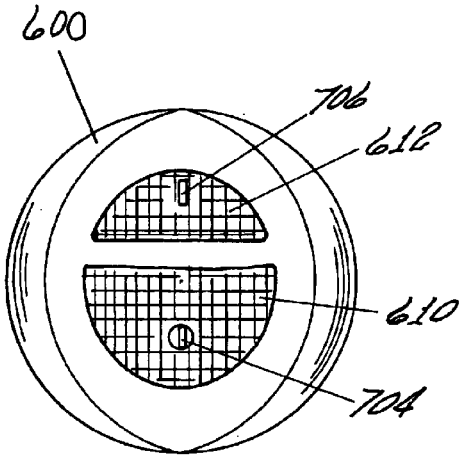
FIG. 25 is a pictorial representation of a bag having the outer pocket having a fastening member in the form of rotatable fastener and a flap operatively attached to the exterior surface of the outer member and wherein the flap has a mating member in the form of an aperture.

In FIG. 25, the pictorial representation of a bag having an exterior surface of an outer member 600 having an outer pocket 610 having a flap 612 with the flap being operatively attached to the exterior surface of an outer member 600. The outer pocket 610 has a fastening member in the form of rotatable fastener 704 and the flap 612 operatively attached to the exterior surface of the outer member 600 and has a mating member in the form of an aperture 706.

Figure 26:
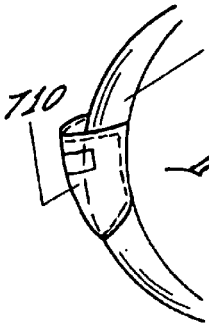
FIG. 26 is a pictorial representation of an outer pocket having an entryway that is formed of a material giving the appearance of a blue jean material.

The pictorial representation FIG. 26 represents an outer pocket 710 having an entryway wherein the outer pocket is formed of a material giving the appearance of a blue jean material.

Figure 27:
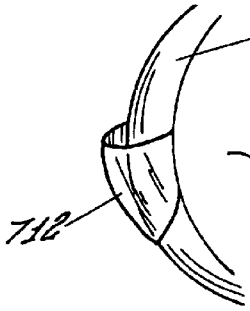
FIG. 27 is a pictorial representation of an outer pocket having an entryway that is formed of a material giving a desired decorative appearance such as for example, a solid fabric formed of a material giving the appearance of a clear material or the appearance of a camouflage material.

FIG. 27 is a pictorial representation of another outer pocket 712 having an entryway wherein the outer pocket is formed of a material giving a desired decorative appearance such as for example, a solid fabric formed of a material giving the appearance of a clear material or the appearance of a camouflage material.

Figure 28:
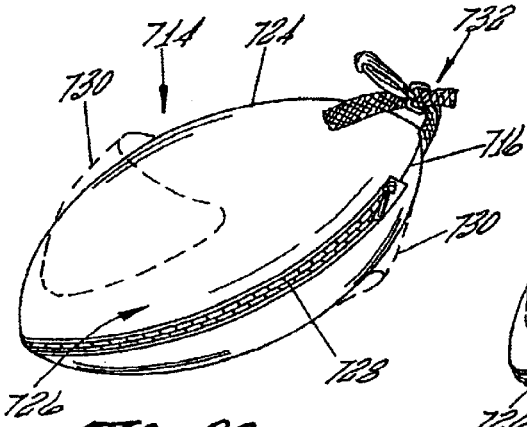
FIG. 28 is a front, left side and top perspective view of yet another embodiment of a bag in the form of a football which is a variation of FIG. 6 having an outer member including an opening formed therein in a selected direction and a carrying handle located above the opening and remaining oriented substantially perpendicular to the opening and wherein the bag has located on the outer member at least two outer pockets each having an entryway.
Figure 29:
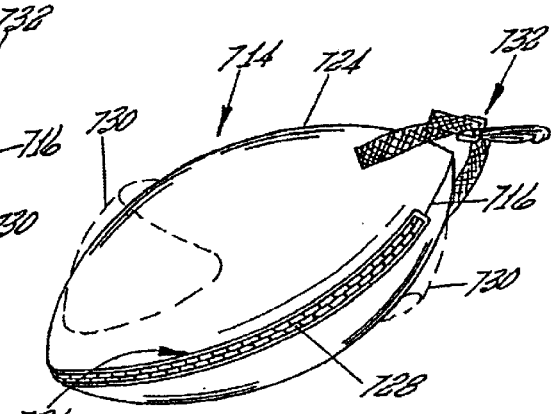
FIG. 29 is a rear, right side and bottom perspective view of the embodiment of FIG. 28

FIGS. 28 and 29 illustrate an embodiment wherein the bag, shown generally as 714 is in the shape of a football generally as illustrated in FIGS. 6 through 9. In FIGS. 28 and 29, an opening 726 is located to extend along the seam 716 of the football shaped bag, in the same manner as illustrated in FIGS. 8 and 9. In the embodiment of FIGS. 28 and 29, the opening 726 is in the form of a zipper 728. A carrying handle shown generally as 732 is operatively connected to the outer surface 724 at a location which is substantially parallel to the seam 716 including zipper 728.

In the embodiment of FIGS. 28 and 29, two mesh pockets shown as 730, are operatively attached to exterior surface of outer member 724 and in spaced opposed locations, both of which are positioned away from the opening 726.

Figure 30:
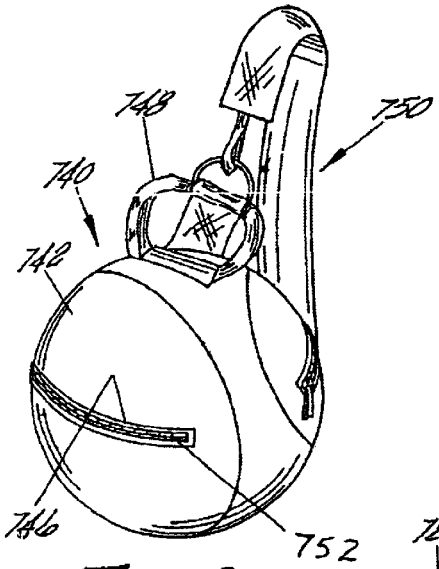
FIG. 30 is a front elevational view of still yet another embodiment of a circular shaped ball bag comprising a variation of FIG. 14 comprising an outer member having an opening extending in a selected direction on the outer member wherein a portion of the opening is at least perpendicular to the handle, a fastening member operatively connected to the opening and a ruggedized carrier.

FIG. 30 illustrates a circular shaped ball bag 740, which is a variation of FIG. 14, comprising an outer member 742 having an opening 746 extending in a selected direction on the outer member wherein a portion of the opening is at least substantially perpendicular to the handle 748 including a fastening member 748, e.g., a zipper, operatively connected to the opening and a ruggedized carrier shown generally as 750.

Figure 31:
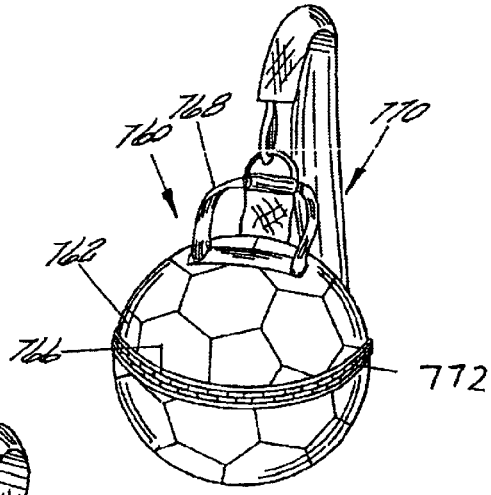
FIG. 31 is a front elevational view of still yet another embodiment of a circular shaped ball bag comprising a combination of FIGS. 12 and 14 comprising an outer member having an opening extending in a selected direction on the outer member wherein a portion of the opening is at least perpendicular to the handle, a fastening member operatively connected to the opening and a ruggedized carrier.

FIG. 31 is a front elevational view of still yet another embodiment of a circular shaped ball bag 760 comprising a combination of FIGS. 12 and 14. The ball bag 760 comprising an outer member 762 having an opening 766 extending in a selected direction on the outer member 742 wherein a portion of the opening 766 is at least substantially perpendicular to the handle 768 wherein the opening 766 includes a fastening member, e.g., a zipper 768, operatively connected to the opening 766 and a ruggedized carrier 770.

Figure 32:
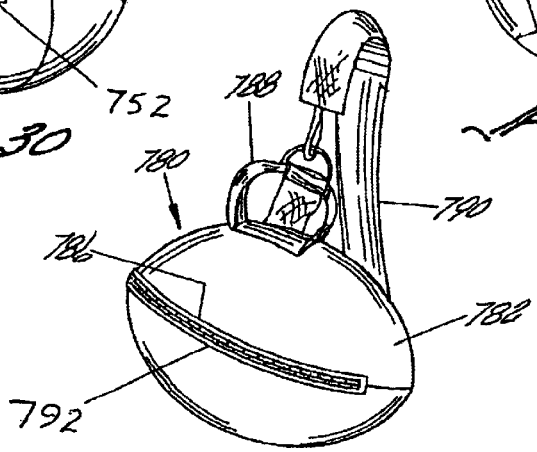
FIG. 32 is a front elevational view of still yet another embodiment of a circular shaped ball bag comprising a combination of FIGS. 8 and 14 comprising an outer member having an opening extending in a selected direction on the outer member wherein a portion of the opening is at least perpendicular to the handle, a fastening member operatively connected to the opening, a ruggedized carrier and at least one outer pocket shown as a dashed line.

FIG. 32 is a front elevational view of still yet another embodiment of a football shaped ball bag 780 comprising a combination of FIGS. 8 and 14. The football shaped ball bag 780 comprising an outer member 782 having an opening 786 extending in a selected direction on the outer member 782, similar to the location of the fastener 152 in FIGS. 8 and 9, wherein a portion of the opening 786 is at least substantially perpendicular to the handle 788 wherein the opening 786 includes a fastening member, e.g., a zipper 788, operatively connected to the opening 786 and a ruggedized carrier 790

Although the preferred embodiment of the present invention is used in circular ball shapes or football shapes, the bag can be formed in any ball shaped article and be adapted to carry and transport any ball shaped article.

It is also envisioned that the teachings of the present invention can be used with other carrying handles such as shoulder straps or any well carrying handles or devices known in the prior art including devices equivalent to carrying handles, ruggidized carrier, shoulder straps, carrying straps for pack backs and the like.

Further, person skilled on the art can identify other applications where the teachings of the present invention can be utilized and all such applications are envisioned by the teachings herein.

What is claimed is:

1. A bag for holding an outer member having an interior and an exterior surface configured in the shape of a ball and defining an inner enclosed space, said exterior surface including an opening formed therein in a selected direction and in communication with said inner enclosed space affording the insertion and removal of a ball from said outer member:

a carrying handle connected in a predetermined position to said outer member at a location other than the opening, said carrying handle having a first strap member having a first end and a second end, said first end being operatively connected to said outer member, said second end terminating in a strap connecting member, said carrying handle having a second strap member having a first end and a second end, said first end of said second strap member being operatively connected to said exterior surface of said outer member, said second end of said second strap member being operatively connected to said strap connecting member wherein said strap connecting member and said second end of said second strap are moveable relative to each other;

a fastening member having an open position and a closed position, said fastening member being operatively connected to said opening formed in the exterior surface of said outer member and being adapted to make said opening an unsecured opening when said fastening member is in the open position and adapted to make said opening a secured opening when the fastening member is in a closed position;

at least one outer pocket positioned on and protruding outwardly from the exterior surface of said outer member at a location other than the opening and having an entryway enabling the insertion and removal of an article from said one outer pocket; and an elongated carrying strap having a first end and a second end, said first end of said elongated carrying strap being operatively connected to said first end of said first strap member and said second end of elongated carrying strap being operatively coupled to the second end of said second strap member.

2. The bag of claim 1 having at least two outer pockets positioned on said exterior surface of the outer member and protruding outwardly at a location other than said opening and spaced from said carrying handle, said at least one outer pocket having an entryway enabling the insertion and removal of an article from said at least one outer pocket independent of a ball being located in said inner enclosed space.

3. The bag of claim 1 wherein said elongated carrying strap has a length and is configured to form at least one selected form the group consisting of a pack sac and a knapsack.

4. The bag of claim 1 wherein the configured shape of a ball is in the shape of a round ball.

5. The bag of claim 1 wherein the configured shape of a ball is in the shape of a basketball.

6. The bag of claim 1 wherein the configured shape of a ball is in the shape of a baseball.

7. The bag of claim 1 wherein the configured shape of a ball is in the shape of a soccer ball.

8. The bag of claim 1 wherein said one outer pocket is formed of a solid fabric.

9. The bag of claim 1 wherein said one outer pocket is formed of a mesh fabric.

10. The bag of claim 1 wherein said one outer pocket includes an interior cavity and said entryway communicates with and provides access to said interior cavity.

11. The bag of claim 1 wherein said entryway includes a zipper which has an open position and a closed position, said zipper when in an open position affording access to the interior cavity of said one outer pocket.

12. The bag of claim 1 further comprising a flap operatively connected to at least one of said entryway and said exterior surface of the outer member, said flap having an open position and a closed position, said flap when in an open position affording access through said entryway to the interior cavity of said one outer pocket.

13. The bag of claim 12 wherein said outer pocket includes a second fastening member which cooperates with a mating member located on at least one of a flap and exterior surface of the outer member.

14. The bag of claim 13 wherein said second fastening member and said mating member are mating elements defining a hook and loop fastener.

15. The bag of claim 13 wherein said second fastening member is at least one of a button and a button hole and said mating member is the other of said at least one of a button and a button hole.

16. The bag of claim 13 wherein said second fastening member is at least one of a rotatable fastener and an aperture for receiving a rotatable fastener and said mating member is the other of said at least one of a rotatable fastener and an aperture for receiving a rotatable fastener.

17. The bag of claim 9 wherein said mesh fabric is formed of an elastic material.

* * * * *